US011833649B2

(12) United States Patent
Schleiminger et al.

(10) Patent No.: US 11,833,649 B2
(45) Date of Patent: Dec. 5, 2023

(54) HAND TOOL

(71) Applicant: KNIPEX-Werk C. Gustav Putsch KG, Wuppertal (DE)

(72) Inventors: Jan Schleiminger, Solingen (DE); Tim Liedtke, Solingen (DE)

(73) Assignee: Knipex-Werk C. Gustav Putsch KG, Wuppertal (DE)

( * ) Notice: Subject to any disclaimer, the term of this patent is extended or adjusted under 35 U.S.C. 154(b) by 477 days.

(21) Appl. No.: 17/050,208

(22) PCT Filed: Apr. 25, 2019

(86) PCT No.: PCT/EP2019/060599

§ 371 (c)(1),
(2) Date: Oct. 23, 2020

(87) PCT Pub. No.: WO2019/207035

PCT Pub. Date: Oct. 31, 2019

(65) Prior Publication Data

US 2021/0094152 A1 Apr. 1, 2021

(30) Foreign Application Priority Data

Apr. 26, 2018 (DE) ..... 10 2018 110 108.2

(51) Int. Cl.
*B25B 7/06* (2006.01)
*B25B 7/08* (2006.01)
(Continued)

(52) U.S. Cl.
CPC ..... *B25B 7/06* (2013.01); *B25B 7/08* (2013.01); *B26B 17/00* (2013.01); *B25B 7/02* (2013.01); *B25B 7/22* (2013.01)

(58) Field of Classification Search
CPC .... B25B 7/06; B25B 7/08; B25B 7/02; B25B 7/22; B26B 17/00
See application file for complete search history.

(56) References Cited

U.S. PATENT DOCUMENTS 3,416,226 A * 12/1968 Pfaffenbach ..... A01G 3/02 30/271
4,607,548 A * 8/1986 Anderson ..... B25B 7/00 30/261

(Continued)

FOREIGN PATENT DOCUMENTS

GB 785 709 A 11/1957

OTHER PUBLICATIONS

International Search Report of PCT/EP2019/060599, dated Aug. 5, 2019.

*Primary Examiner* — Seahee Hong
(74) *Attorney, Agent, or Firm* — Collard & Roe, P.C.

(57) ABSTRACT

A hand tool has first and second tool legs that are connected in a pivot region and which overlap in an overlapping region both in an open state of the hand tool and in a closed state of the hand tool. The tool legs interact with a spring such that the tool legs can be pivoted, even beyond a basic open position, into an extended open position by the user in applying manual force against the force of the spring, the spring coming into action in the case of the additional pivot movement of the hand tool legs beyond the basic open position and/or in the case of a closing pivoting movement of the hand tool legs acts on different bearing surfaces of the hand tool legs.

6 Claims, 8 Drawing Sheets

(51) Int. Cl.

| | |
|---|---|
| ***B26B 17/00*** | (2006.01) |
| ***B25B 7/02*** | (2006.01) |
| ***B25B 7/22*** | (2006.01) |

(56) References Cited

U.S. PATENT DOCUMENTS

| | | | | | |
|---|---|---|---|---|---|
| 4,625,596 | A * | 12/1986 | Makus | H02G 1/1214 | 30/91.2 |
| 5,253,557 | A * | 10/1993 | Dolak | B25B 7/00 | 294/118 |
| 6,134,993 | A * | 10/2000 | Tally | B25B 7/18 | 81/394 |
| 6,176,158 | B1 * | 1/2001 | Chen | B25B 7/08 | 81/394 |
| 6,588,039 | B1 * | 7/2003 | Bates | B25B 7/02 | 7/107 |
| 7,802,496 | B2 * | 9/2010 | Pisczak | H02G 1/1224 | 30/90.1 |
| 2005/0011321 | A1 * | 1/2005 | Hsien | B25B 7/08 | 81/417 |
| 2008/0104765 | A1 * | 5/2008 | Li | B25B 7/04 | 7/128 |
| 2012/0011970 | A1 * | 1/2012 | Chen | B25B 7/08 | 81/427 |
| 2014/0060264 | A1 * | 3/2014 | Steele | B25B 7/02 | 81/324 |
| 2019/0105231 | A1 * | 4/2019 | Doretti | A61J 7/0007 | |
| 2019/0262099 | A1 * | 8/2019 | Lahti | B25B 7/08 | |

* cited by examiner 7
3
1
x
6
2
4
5
13
8
10
9
19
x
12
11

1
7
3
K
21
4
III
14
12
10
8
9
L
L
6
2
B
20
22
x
5
13
19
11
III

E
IV
18
2
12
14
13
3
19
IV
E

HAND TOOL

CROSS REFERENCE TO RELATED APPLICATIONS

This application is the National Stage of PCT/EP2019/060599 filed on Apr. 25, 2019, which claims priority under 35 U.S.C. § 119 of German Application No. 10 2018 110 108.2 filed on Apr. 26, 2018, the disclosure of which is incorporated by reference. The international application under PCT article 21(2) was not published in English.

TECHNICAL FIELD

The invention pertains to a hand tool such as pliers or shears with a first and a second tool leg, which are held rotatably relative to one another in a pivot region, wherein the tool legs overlap in an overlapping region in an open state of the hand tool, as well as in a closed state of the pliers, and wherein the tool legs interact with a spring that predefines a basic open position of the hand tool.

PRIOR ART

Hand tools of the type in question are known in different variations, for example in the form of gripping pliers or also in the form of cutting pliers or shears. We refer to U.S. Pat. No. 4,607,548 as an example in this respect. This US patent discloses pliers that comprise a spring for acting upon the plier legs in the direction of an open position of the pliers. The spring is accommodated in a window-like opening in the overlapping region of the plier legs. The plier legs can be rotationally displaced from the open position in the direction of a closed position of the pliers against the force of the spring acting upon these plier legs. Thusly designed shears are also known, for example in the form of wire rope cutters.

A shears is known from GB 785,709 A, wherein the displacement of the pliers legs into the open position takes place by means of a spring accommodated in the overlapping region of the pliers legs. The same bearing surfaces of the pliers legs act upon the spring, both when moving into the open position as well as when moving from the open position into the closed position. Further, from US 2012/0011970 A1 a hand tool in form of pliers is known, wherein the opening starting from a closed position into a basic open position takes place against the force of a spring which is also accommodated in the overlapping region of the pliers legs. Further, the opening into an expanded open position of the hand tool is possible, however without acting upon the spring.

SUMMARY OF THE INVENTION

In light of the above-described the prior art, an objective of the invention can be seen in additionally enhancing a hand tool of the type in question, particularly in terms of handling.

According to a first inventive idea, this objective is potentially attained with a hand tool, in which it is proposed that the user can also pivot the tool legs beyond the basic open position into an expanded open position by applying a manual force against the force of the spring, wherein the spring, which comes into effect during an additional pivoting motion of the tool legs beyond the basic open position and/or during a closing pivoting motion of the tool legs, acts upon different bearing surfaces of the tool legs.

A hand tool with increased service value is created as a result of the above-described design. The hand tool can be moved beyond the basic open position into an expanded open position. The tool jaw therefore can be expanded in comparison with the basic open position, e.g. in order to accommodate an object to be cut or held with a larger cross section. This expanded open position may be a position of the hand tool, in which the tool legs, which accordingly are spread apart farther in this position, potentially can no longer be used for one-hand operation in the handle region. The normal use of the hand tool therefore is typically limited to a motion spectrum of the tool legs between the closed position and the basic open position.

The basic open position preferably can be defined solely by the relaxed position of the spring without stops. The tool jaw is moved from this basic open position in the closing direction as a result of a rotational displacement of the tool legs against the spring force, wherein correspondingly effective bearing surfaces of the tool legs interact with the spring.

The tool legs furthermore can be pivoted from the basic open position into an expanded open position by likewise acting upon the spring and thereby correspondingly acting against the force of the spring, wherein different bearing surfaces of the tool legs interact with the spring in this case.

After the suspension of the corresponding holding forces exerted upon the tool legs, the tool legs preferably are pivoted back automatically from the expanded open position into the basic open position solely as a result of the restoring force of the spring acting upon these tool legs, wherein this automatic backward pivoting motion likewise takes place from the closed position in the direction of the basic open position.

In another preferred embodiment of the hand tool, the orientation of the tool legs always corresponds to the basic open position regardless of a starting position (closed position or expanded open position or an intermediate position) after the load exerted upon the tool legs no longer exceeds the spring force.

The spring may be subjected to a compressive load when a load is exerted upon the tool legs in the closing direction, as well as when a load is exerted upon the tool legs beyond the basic open position in the direction of the expanded open position. Accordingly, the spring may be a compression spring, which in a preferred embodiment is subjected to a compressive load by the bearing surfaces of the tool legs in any orientation of the tool legs that deviates from the basic open position.

In a potential embodiment, an interacting end of the spring interacts with the first tool leg during a pivoting motion of the tool legs in the direction of the closed position and with the second tool leg during a pivoting motion of the tool legs in the opening direction beyond the basic open position. In this way, both tool legs accordingly provide bearing surfaces that can be moved into an active position, wherein each interacting end of the spring interacts with the bearing surface of one or the other tool leg depending on the displacement of the tool legs from the basic open position, in which the spring is at least approximately in its relaxed position, in the direction of a closed position or in the direction of an expanded open position.

In the basic open position, at least one interacting end or, if applicable, both interacting ends of the spring may interact with both associated bearing surfaces of the two tool legs. Starting from this position, a respective bearing surface of one or the other tool leg acts upon the associated interacting end of the spring during a corresponding pivoting motion of the tool legs.

According to a preferred embodiment, the spring may be respectively realized in the form of a cylindrical compression spring or a helical compression spring. It is accordingly preferred to use a steel spring. However, it is also possible to use other spring elements that are capable of exerting a restoring force against a compressive force such as correspondingly designed spring elements of a plastic material.

In a potential embodiment, the spring may lie in a groove that essentially extends in the direction of a longitudinal spring axis in one tool leg. If the spring is realized in the form of a compression spring, the groove can in this case preferably be designed, particularly with respect to its dimensions, in such a way that a compression of the spring, as well as a relaxing motion of the spring in the direction of a basic position, can take place in an unobstructed manner. Furthermore, the groove may be formed, for example, along a circular arc. The geometric center of this circular arc may in this case lie in the region of the pivoting axis, about which the tool legs can be pivoted.

The spring may furthermore lie in grooves that essentially extend in the direction of the longitudinal spring axis in both tool legs. The grooves are open on the sides that face one another such that they altogether form a spring chamber for the spring.

In the context of the invention, an end face of a groove, which is essentially formed in the direction of the longitudinal spring axis, is a bearing surface for an interacting end of the spring. Accordingly, this interacting end of the spring alternately interacts with the end face of one or the other groove, which is essentially formed in the same direction of the longitudinal spring axis.

According to another advantageous embodiment, the spring may be located in the overlapping region of the tool legs. This overlapping region may correspond to the pivot region of the two tool legs or be formed directly adjacent thereto. The spring may therefore also be arranged near the pivoting axis.

In an embodiment that is particularly advantageous in terms of functionality, the spring may be arranged such that it is neither visible in the closed position nor in the basic open position or the expanded open position. In such an embodiment, the spring preferably is in a concealed position and accordingly protected from external mechanical influences, as well as potential dirt accumulation, in any tool position or in any pivoting position of the tool legs, respectively. The concealed position may be realized in that the grooves of the tool legs, which in a preferred embodiment accommodate the spring, are respectively closed or covered circumferentially with respect to a horizontal projection, as well as toward the outer side of the tool legs. The installation of the spring can take place in the course of the assembly of the tool legs.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
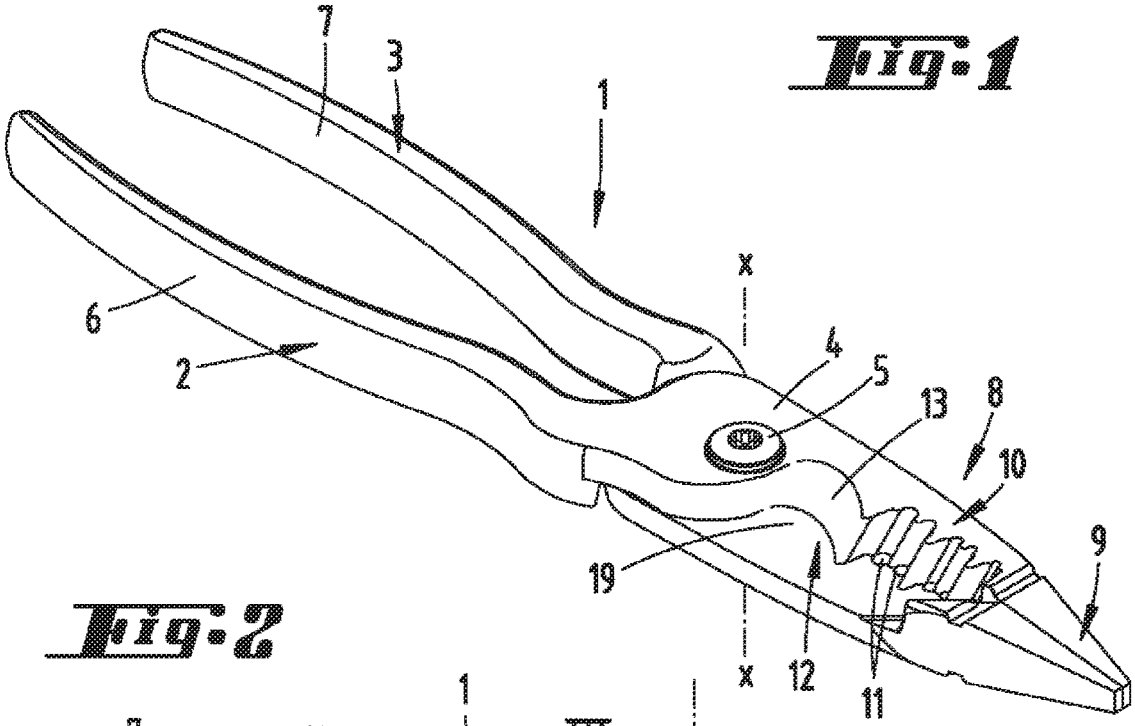
FIG. 1 shows a perspective representation of a hand tool in the closed position concerning a first embodiment.
Figure 2:
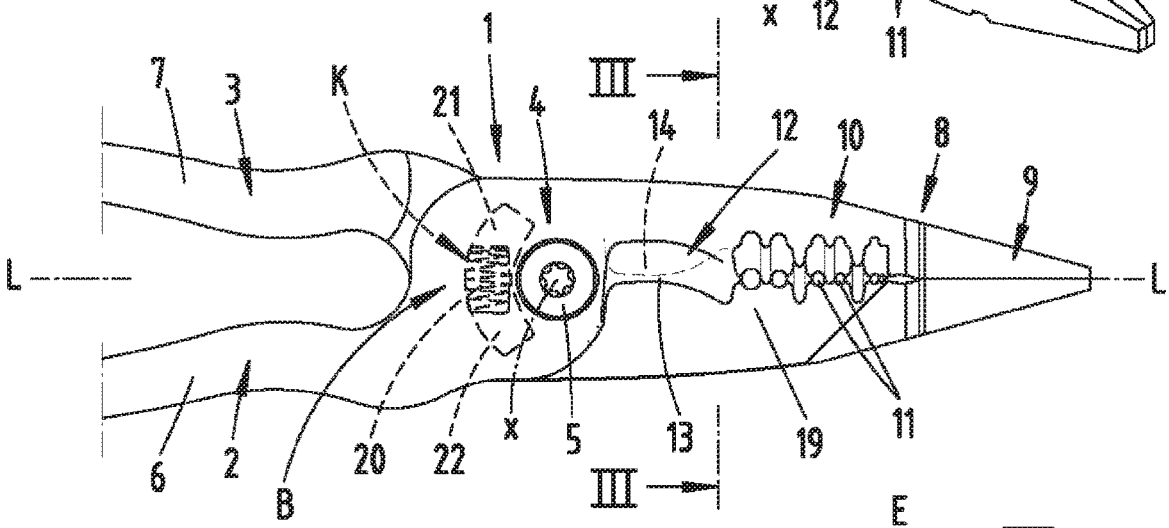
FIG. 2 shows a partial representation of the hand tool in the form of a top view.
Figure 3:
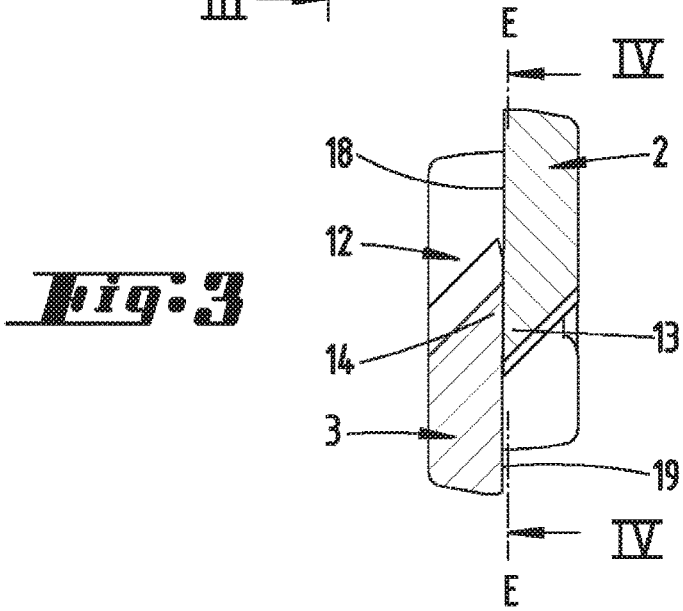
FIG. 3 shows an enlarged section along the line III-III in FIG. 2.

A hand tool 1 with two tool legs 2 and 3, which are only partially illustrated, e.g., in FIG. 2, is initially described with reference to FIG. 1, wherein said tool legs are held rotatably relative to one another about a geometric axis of rotation x in a pivot region 4. The geometric axis of rotation x is defined by a pivot pin 5, which extends through the tool legs 2 and 3 in an overlapping region B.

The first plier leg 2 forms a handle section 6 and the second plier leg 3 forms a handle section 7 on one side of the pivot region 4 whereas a jaw region 8 is formed on the other side of the pivot region 4.

According to the first exemplary embodiment illustrated in FIGS. 1 to 12, the jaw region 8 specifically may have different functional regions that are formed behind one another, i.e. successively referred to a longitudinal line L-L. For example, a flat jaw region 9 may be formed on the side of the tip, i.e. on the free ends of the tool legs 2 and 3.

The jaw region 8 may have a cutting region 12 near the pivot point, wherein said cutting region has a first cutting edge 13 on the first tool leg 2 and a second cutting edge 14 on the second tool leg 3.

According to the first exemplary embodiment, a stripping region 10 may furthermore be provided between the cutting region 12 and the flat jaw region 9, wherein said stripping region comprises cutting formations 11 with different diameters in order to make it possible to strip wires with different cross sections.

Figure 13:
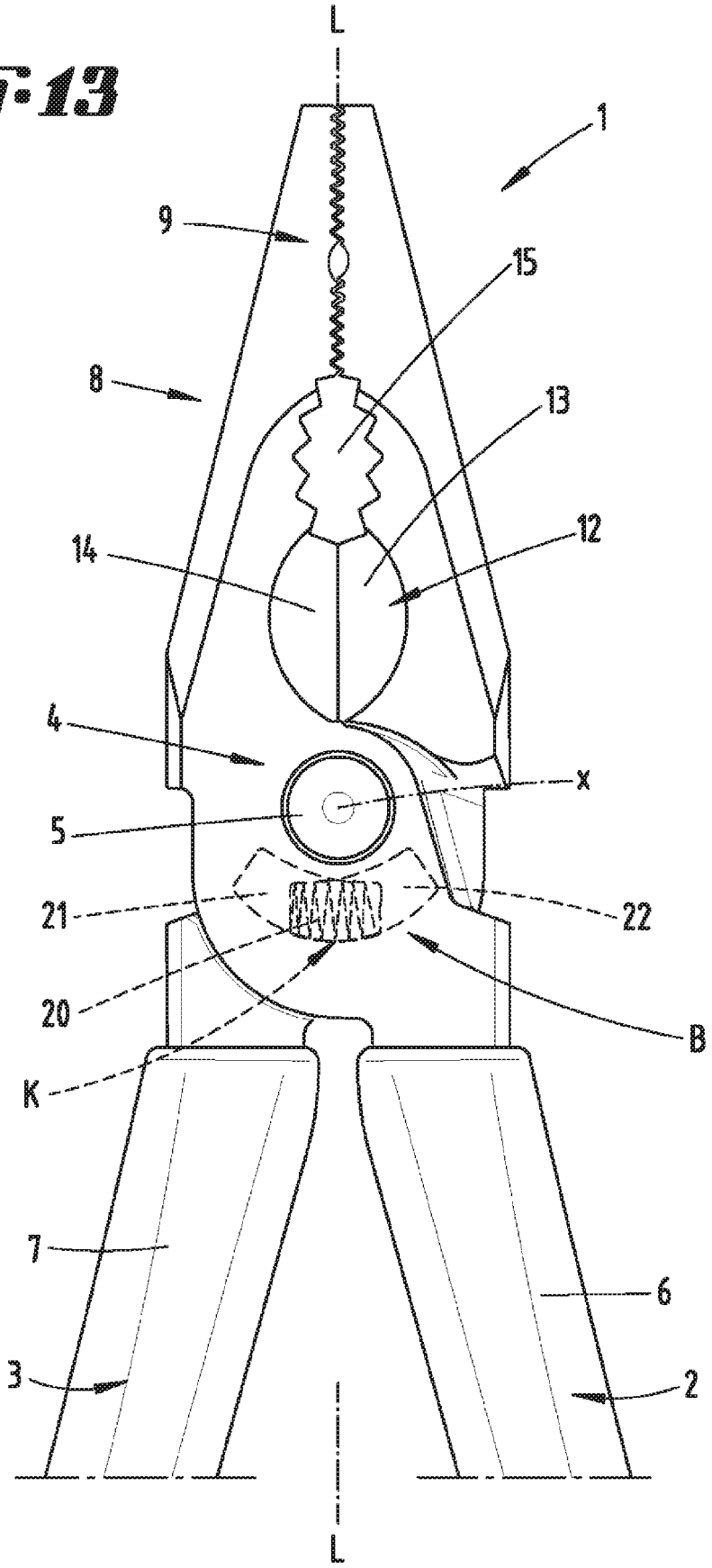
FIG. 13 shows a partial view of pliers according to another embodiment concerning the closed position.

According to the illustrations in FIGS. 13 to 16, the hand tool 1 may also be realized in the form of so-called universal pliers, e.g. as illustrated in FIG. 13, wherein said universal pliers have a cutting region 12 and a flat jaw region 9, as well as a burner hole 15 formed between these regions.

Figure 14:
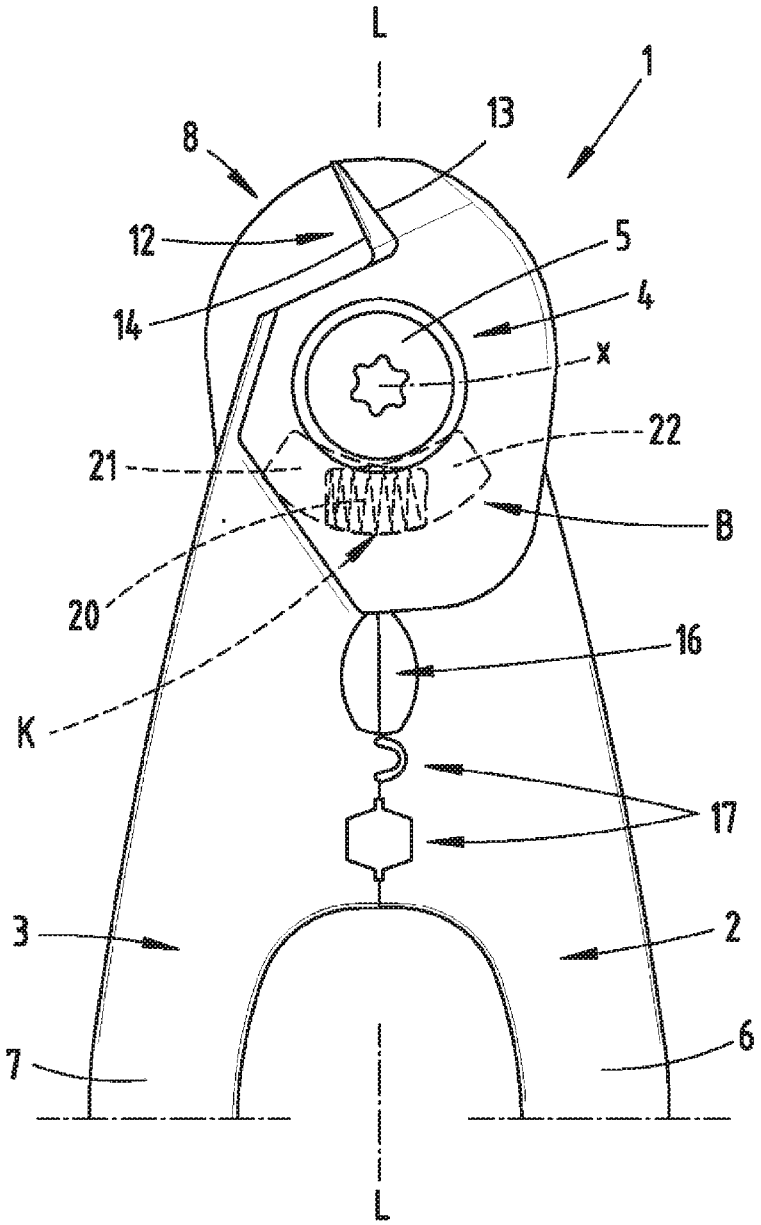
FIG. 14 shows another partial view of pliers according to a third embodiment concerning the closed position.

According to the illustration in FIG. 14, the hand tool 1 may also be realized in the form of wire rope cutters with a first cutting region 12, which lies opposite of the handle regions 6 and 7 referred to the axis of rotation x, and a second cutting region 16, which is formed between the handle regions 6 and 7 near the pivot point. In this embodiment, multiple crimping regions, in this case two crimping regions 17, may furthermore be provided along the longitudinal axis L-L.

Figure 15:
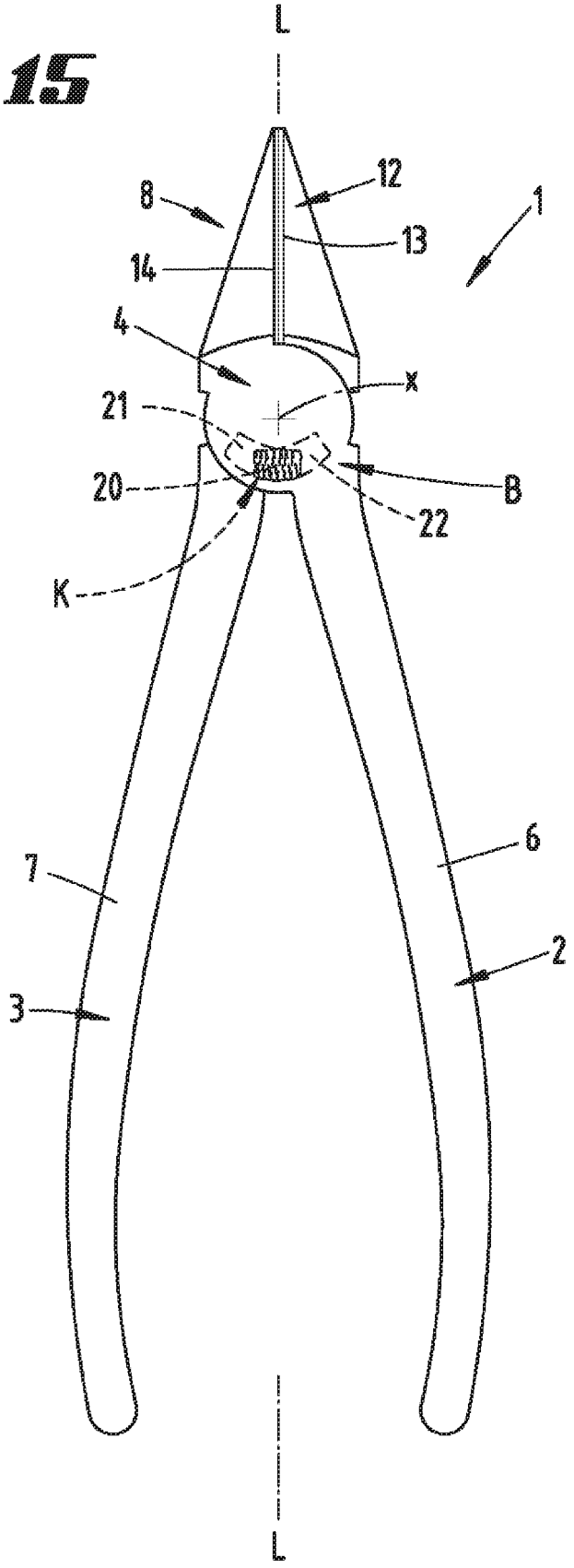
FIG. 15 shows a view of a hand tool according to a fourth embodiment in the closed position.

FIG. 15 shows a hand tool 1 in the form of cutting pliers, which accordingly have a cutting region 12.

Figure 16:
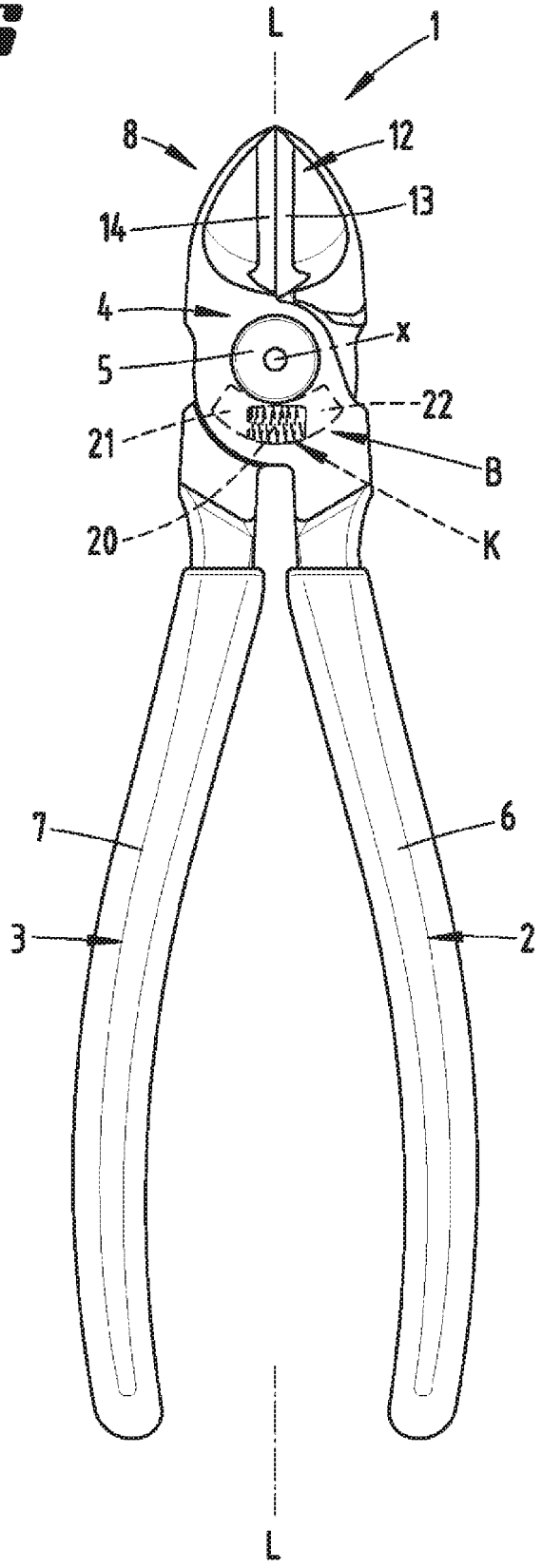
FIG. 16 shows a view of another hand tool according to a fifth embodiment concerning the closed position.

A hand tool 1 in the form of side cutters is illustrated in FIG. 16.

Furthermore, the hand tool 1 may also be realized in the form of any gripping pliers, center or front cutting pliers, stripping pliers, cable pliers, crimping pliers or also wire strippers. The hand tool 1 particularly may be realized in the form of pliers or shears, in which the tool legs 2 and 3 overlap in an overlapping region B in any pivoting position of the tool legs.

The tool legs 2 and 3 have planar sliding surfaces 18 and 19 that face one another, particularly in the jaw region 8, as well as in the overlapping region B and therefore in the pivot region 4. The cutting edges 13 and 14 are formed in the region of the sliding surfaces 18, 19. Accordingly, the bearing surfaces 18 and 19 of the tool legs 2 and 3 move along a shearing plane E, which is aligned transverse to the axis of rotation x, during a pivoting motion of the tool legs 2 and 3 about the axis of rotation x.

The tool legs 2 and 3 interact with a spring 20, particularly a cylindrical compression spring, which predefines a basic open position of the pliers 1 or the tool legs 2 and 3, respectively. This basic open position is with respect to the first exemplary embodiment illustrated in FIGS. 4 to 6.

Figure 4:
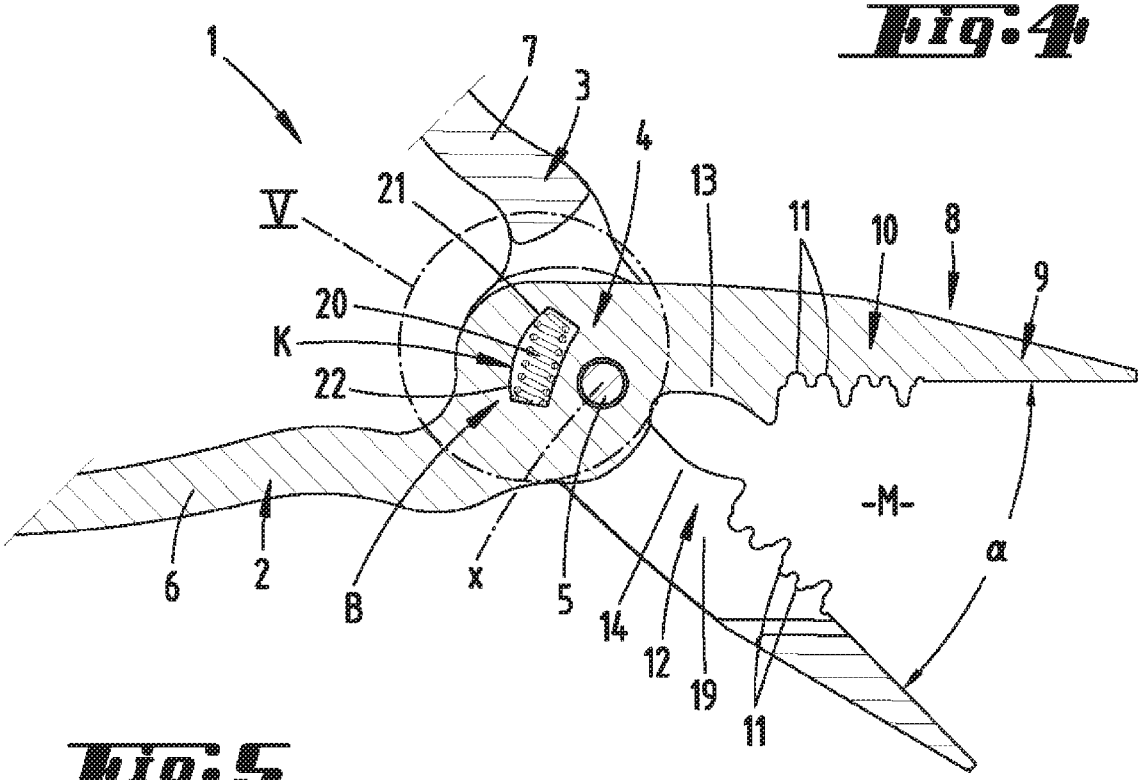
FIG. 4 shows a section along the line IV-IV in FIG. 3, in which the tool legs are held in a basic open position by a spring.

The tool jaw M formed in the jaw region 8 is opened in the basic open position (compare to FIG. 4). The gripping surfaces in the flat jaw region 9, as well as the cutting formations 11 of the stripping region 10 and the cutting edges 13 and 14 of the cutting region 12, are exposed in order to take hold of a part to be held or cut or to be stripped, respectively.

In the basic open position, the leg sections defining the jaw region 8 assume an angle α between approximately 30 and 40°, e.g. about 35°, relative to the axis of rotation x.

The spring 20 is provided in the overlapping region B near the pivot point, wherein each tool leg 2 and 3 initially comprises a groove 21, 22 in the overlapping region B for this purpose. The groove 21, 22 is respectively provided on the side of the handle section, namely in the form of an essentially pocket-like depression that respectively starts at the respective sliding surface 18, 19 and opens into the sliding surface 18, 19.

With respect to a vertical projection into the cutting plane E, each groove 21, 22 is essentially formed along a circular arc section, wherein a geometric center of this circular arc section may lie within the overlapping region B.

The radial width of each groove 21, 22 with respect to the axis of rotation x is identical to or preferably greater than the diameter dimension of the spring 20, e.g. by a factor between 1.2 and 1.5.

According to a preferred embodiment, the circular arc length of each groove 21, 22 may correspond to the relaxed length of the spring 20 measured along a longitudinal spring axis z.

Each end face 23 resulting in the extending direction of the groove 21, 22 forms a respective bearing surface 24, 25 and 26, 27.

The depth a of each groove 21, 22 measured perpendicular to the shearing plane E and starting from the respectively associated sliding surface 18, 19 corresponds at least to half the diameter dimension b of the spring 20, preferably between approximately 1.1-times and 1.3-times the diameter dimension b.

Figure 6:
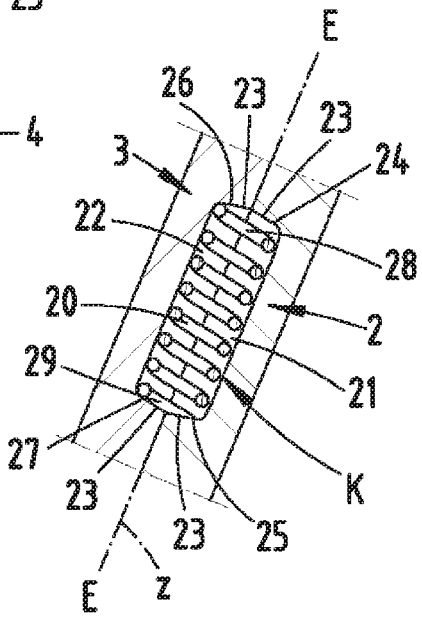
FIG. 6 shows a section along the line VI-VI in FIG. 5.

As a result of this design, a spring 20 realized in the form of a cylindrical compression spring lies in a spring chamber K that is completely enclosed by the two grooves 21 and 22 as illustrated in the sectional representation according to FIG. 6, wherein the shearing plane E extends through said spring chamber K about centrally referred to a direction extending transverse to the axis of rotation x.

The respective interacting ends 28 and 29 of the spring 20, which are formed on the respective ends in the direction of the longitudinal spring axis z, interact with the respective bearing surfaces 24, 25 and 26, 27 of the grooves 21 and 22.

Figure 5:
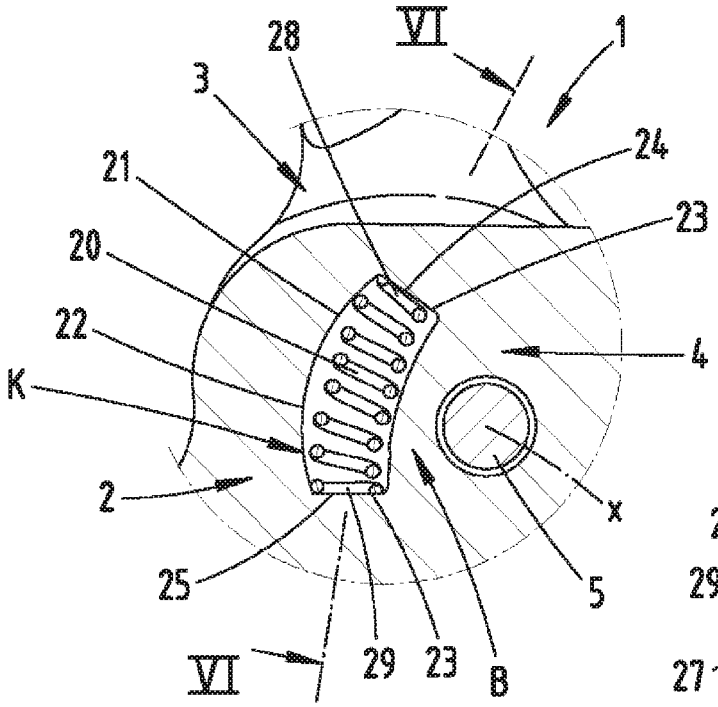
FIG. 5 shows an enlarged detail of the region V in FIG. 4.

In the basic open position according to FIGS. 4 to 6, the interacting end 28 of the spring 20 simultaneously acts upon the bearing surface 24 of the groove 21 in the first tool leg 2, as well as upon the bearing surface 26 of the groove 22 in the second tool leg 3. The other interacting end 29 simultaneously acts upon the bearing surface 25 of the groove 21 in the first tool leg 2, as well as upon the bearing surface 27 of the groove 22 in the second tool leg 3.

As a result of this spring-loading of all bearing surfaces 24 to 27, the tool legs 2 and 3 are held in the basic open position when they are not subjected to any externally acting force.

When the tool legs 2 and 3 are pivoted relative to one another from the basic open position according to FIG. 4, the grooves 21 and 22 are accordingly also rotated relative to one another, namely by correspondingly subjecting the spring 20 lying in the grooves 21 and 22 to a compressive load.

Figure 7:
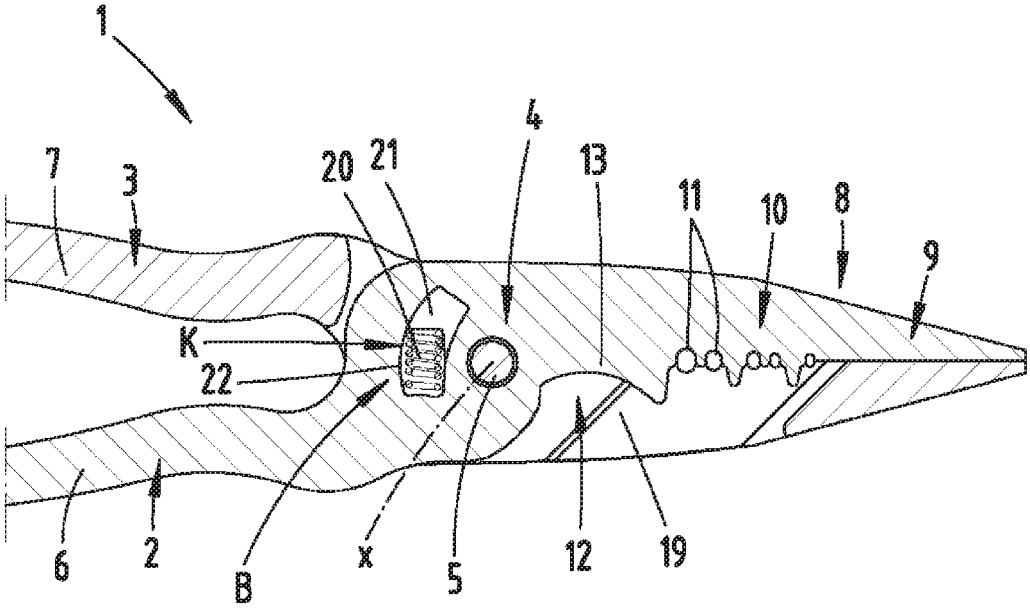
FIG. 7 shows a representation corresponding to FIG. 4, however, concerning the closed position.
Figure 8:
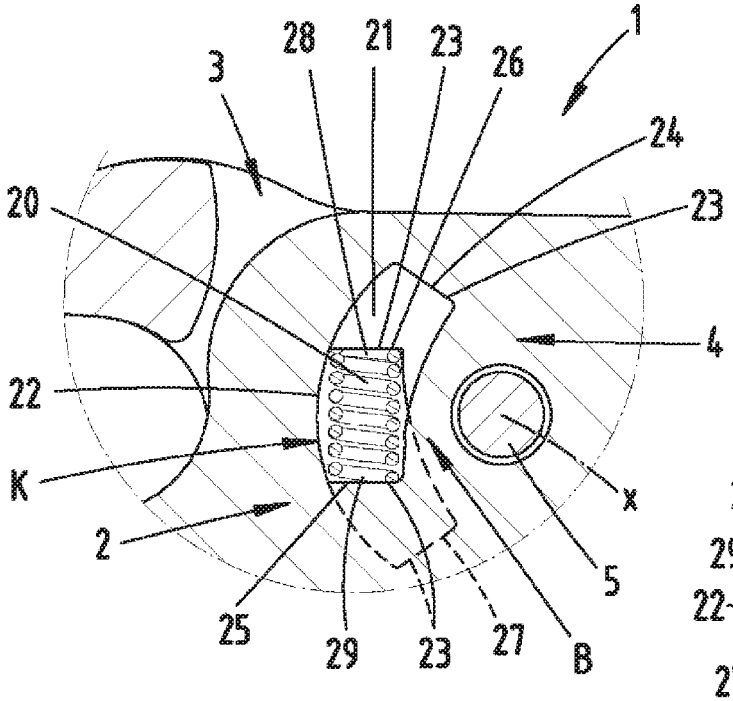
FIG. 8 shows a representation corresponding to FIG. 5 and concerning the tool leg position according to FIG. 7.
Figure 9:
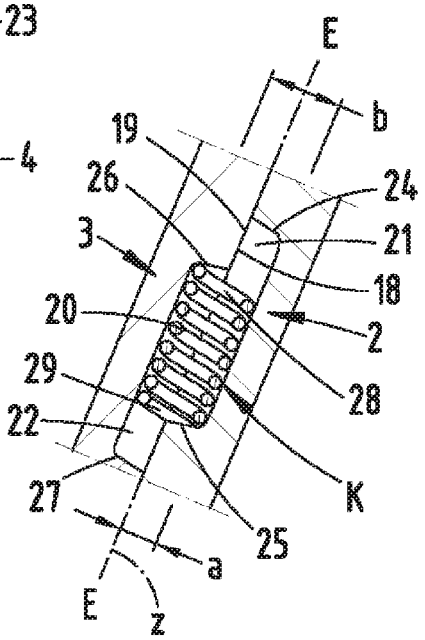
FIG. 9 shows a sectional representation according to FIG. 6, which likewise concerns the tool leg position according to FIGS. 7 and 8.

During a pivoting motion of the tool legs 2 and 3 in the direction of a closed position of the hand tool 1 according to the illustrations in FIGS. 7 to 9, for example, one interacting end 28 of the spring 20 is acted upon by the bearing surface 26 of the groove 22 in the second tool leg 3 whereas the other interacting end 29 of the spring 20 is still supported, but in this position solely supported, on the bearing surface 25 of the groove 21 in the first tool leg 2 (compare in particular to FIGS. 8 and 9).

The spring 20 is compressed in the closed tool position. Once an external force (holding force of the user) ceases to act upon the tool legs 2 and 3, the tool legs 2 and 3 are rotationally drawn back into the basic open position according to FIG. 4 as a result of the relaxation of the spring 20.

Figure 10:
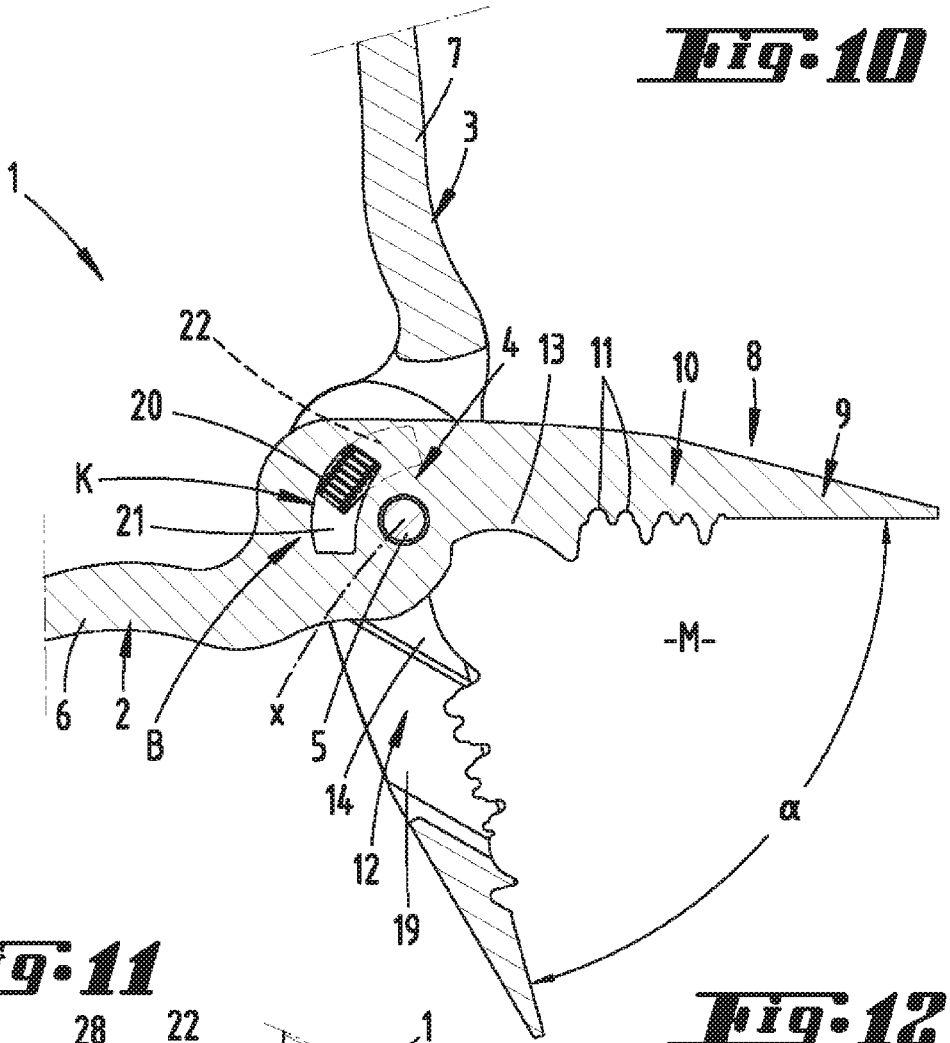
FIG. 10 shows another representation corresponding to FIG. 4 and concerning an expanded open position of the tool legs, in which they are pivoted beyond the basic open position according to FIG. 4 in the opening direction.
Figure 11:
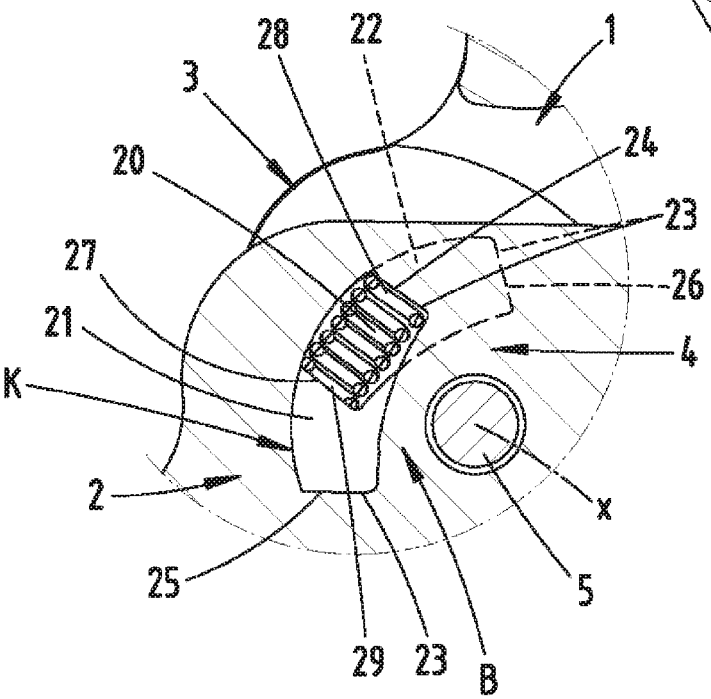
FIG. 11 shows the enlarged detail according to FIG. 5, however, concerning the tool leg position according to FIG. 10.
Figure 12:
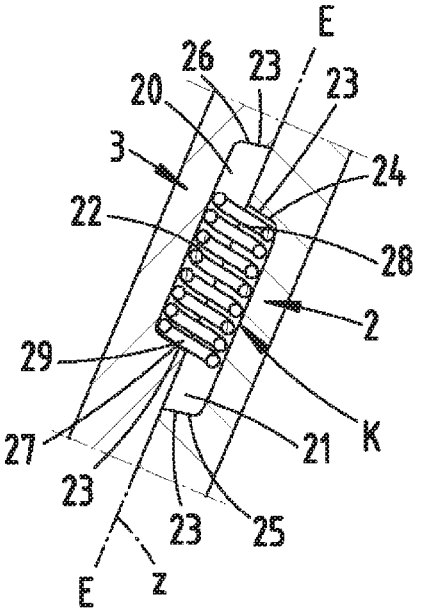
FIG. 12 shows a section according to FIG. 6, which likewise concerns the tool leg position according to FIG. 10.

Furthermore, an expanded open position according to the illustrations in FIGS. 10 to 12 can be reached from the basic open position according to FIG. 4 by pivoting the tool legs 2 and 3 beyond the basic open position in the opening direction. In this expanded open position, an aperture angle α between 70 and 80°, e.g. about 75°, can be reached between the leg sections defining the jaw region 8.

During such a rotational motion from the basic open position, which is directed opposite to a pivoting motion into the closed position, the spring is subjected to a load by the bearing surface 27 of the groove 22 in the second tool leg 3 in the region of the corresponding interacting end 29, wherein the other interacting end 28 of the spring 20 is still supported, but in this case solely supported, on the bearing surface 24 of the groove 21 in the first tool leg 2. In the expanded open position, the spring 20 is compressed between the bearing surfaces 24 and 27 of the two grooves 21 and 22.

Starting from the basic open position, the interacting end 28 of the spring 20 interacts with the bearing surface 25 of the second tool leg 3 during a pivoting motion in the direction of the closed position and with the bearing surface 24 of the first tool leg 2 during a pivoting motion into the expanded open position. The other interacting end 29 of the spring 20 also interacts in such an alternating manner. This interacting end interacts with the bearing surface 25 of the first tool leg 2 in the closed position of the hand tool 1 and with the bearing surface 27 of the second tool leg 3 in the expanded open position.

The illustrations furthermore show that the spring 20 is neither externally visible in the closed position according to the illustrations in FIGS. 1, 2 and 7 to 9, as well as according to FIGS. 13 to 16 with respect to the other embodiments, nor in the basic open position according to FIGS. 4 to 6 or the expanded open position according to FIGS. 10 to 12. In fact, the spring 20 lies in a protected and concealed position.

LIST OF REFERENCE SYMBOLS

1 Hand tool
2 First tool leg
3 Second tool leg
4 Pivot region
5 Pivot pin
6 Handle section
7 Handle section
8 Jaw region
9 Flat jaw region
10 Stripping region
11 Cutting formation
12 Cutting region
13 First cutting edge
14 Second cutting edge
15 Burner hole
16 Cutting region
17 Crimping region
18 Sliding surface
19 Sliding surface
20 Spring
21 Groove
22 Groove
23 End face
24 Bearing surface
25 Bearing surface
26 Bearing surface
27 Bearing surface
28 Interacting end
29 Interacting end
B Overlapping region
E Shearing plane
K Spring chamber
L Longitudinal line
M Tool jaw
a Depth
b Diameter dimension
x Axis of rotation
z Longitudinal spring axis
$\alpha$ Angle

The invention claimed is:

1. A hand tool in the form of pliers having a first tool leg and a second tool leg rotatably connected to the first tool leg in a pivot region of the first tool leg and the second tool leg, each tool leg comprising a handle section and a jaw region integrated with the handle section forming a single piece, wherein the jaw regions have a cutting region formed near the pivot region, wherein said cutting region has a first cutting edge on the first tool leg and a second cutting edge on the second tool leg, wherein the tool legs interact with a spring that predefines a basic open position of the hand tool, wherein the tool legs are pivotable beyond the basic open position into an expanded open position by application of a manual force against a force of the spring, wherein the spring, which comes into effect during an additional pivoting motion of the tool legs beyond the basic open position and during a closing pivoting motion of the tool legs, acts upon different bearing surfaces of the tool legs, wherein the spring is provided in a groove in the handle sections of the tool legs, in an overlapping region of the tool legs near a pivot pin, wherein the groove is in form of a substantially pocket-like depression that starts at a sliding surface of the first tool leg and opens into a sliding surface of the second tool leg, the groove extending along the sliding surfaces of both tool legs substantially in a direction of a longitudinal spring axis.

2. The hand tool according to claim 1, wherein the spring is a cylindrical compression spring.

3. The hand tool according to claim 1, wherein one of the bearing surfaces is formed by an end face of one of the grooves, the one groove extending in the direction of the longitudinal spring axis (z).

4. The hand tool according to claim 1, wherein the spring is not visible in any of the closed state, the basic open position or the expanded open position of the hand tool.

5. A hand tool in the form of pliers having a first tool leg and a second tool leg rotatably connected to the first tool leg in a pivot region of the first tool leg and the second tool leg, each tool leg comprising a handle section and a jaw region integrated with the handle section forming a single piece, wherein the jaw regions have a cutting region formed near the pivot region, wherein said cutting region has a first cutting edge on the first tool leg and a second cutting edge on the second tool leg, wherein the tool legs interact with a spring that predefines a basic open position of the hand tool, wherein the tool legs are pivotable beyond the basic open position into an expanded open position by application of a manual force against a force of the spring, wherein the spring, which comes into effect during an additional pivoting motion of the tool legs beyond the basic open position and during a closing pivoting motion of the tool legs, acts upon different bearing surfaces of the tool legs, wherein the spring is provided in a groove in the handle sections of the tool legs, in an overlapping region of the tool legs near a pivot pin, wherein the groove is in form of a substantially pocket-like depression that starts at a sliding surface of the first tool leg and opens into a sliding surface of the second tool leg, the groove extending along the sliding surfaces of both tool legs substantially in a direction of a longitudinal spring axis, and wherein the spring is subjected to a compressive load when a load is exerted upon the tool legs in the closing direction, as well as when the load is exerted upon the tool legs beyond the basic open position in a direction of the expanded open position.

6. A hand tool in the form of pliers having a first tool leg and a second tool leg rotatably connected to the first tool leg in a pivot region of the first tool leg and the second tool leg, each tool leg comprising a handle section and a jaw region integrated with the handle section forming a single piece, wherein the jaw regions have a cutting region formed near the pivot region, wherein said cutting region has a first cutting edge on the first tool leg and a second cutting edge on the second tool leg, wherein the tool legs interact with a spring that predefines a basic open position of the hand tool, wherein the tool legs are pivotable beyond the basic open position into an expanded open position by application of a manual force against a force of the spring, wherein the spring, which comes into effect during an additional pivoting motion of the tool legs beyond the basic open position and during a closing pivoting motion of the tool legs, acts upon different bearing surfaces of the tool legs, wherein the spring is provided in a groove in the handle sections of the tool legs, in an overlapping region of the tool legs near a pivot pin, wherein the groove is in form of a substantially pocket-like depression that starts at a sliding surface of the first tool leg and opens into a sliding surface of the second tool leg, the groove extending along the sliding surfaces of both tool legs substantially in a direction of a longitudinal spring axis, wherein an interacting end of the spring interacts with the first tool leg during the closing pivoting motion of the tool legs in a direction of the closed position and interacts with the second tool leg during the additional pivoting motion of the tool legs beyond the basic open position in the opening direction.

* * * * *